United States Patent [19]

Thompson

[11] 4,199,035

[45] Apr. 22, 1980

[54] CUTTING AND DRILLING APPARATUS WITH THREADABLY ATTACHED COMPACTS

[75] Inventor: Donald A. Thompson, Westerville, Ohio

[73] Assignee: General Electric Company, Worthington, Ohio

[21] Appl. No.: 899,767

[22] Filed: Apr. 24, 1978

[51] Int. Cl.[2] ..... E21B 13/01

[52] U.S. Cl. ..... 175/410; 175/413

[58] Field of Search ..... 175/329, 374, 409, 410, 175/412, 413, 340; 299/93; 403/361; 407/46, 47, 49, 102, 108; 76/DIG. 11

[56] References Cited

U.S. PATENT DOCUMENTS

| | | | |
|---|---|---|---|
| 861,368 | 7/1907 | Juengst | 407/49 |
| 1,351,003 | 8/1920 | Pace | 175/413 X |
| 1,550,172 | 8/1925 | Körber | 403/361 |
| 2,950,090 | 8/1960 | Swart | 175/340 |
| 3,734,213 | 5/1973 | Goodfellow | 175/374 |
| 3,743,489 | 7/1973 | Wentorf, Jr. et al. | 51/307 |
| 3,771,612 | 11/1973 | Adcock | 175/413 |
| 4,014,395 | 3/1977 | Pearson | 175/410 |
| 4,071,097 | 1/1978 | Fulop et al. | 175/340 X |
| 4,073,354 | 2/1978 | Rowley et al. | 175/329 |

*Primary Examiner*—James A. Leppink

*Attorney, Agent, or Firm*—Douglas B. Little; Dennis A. Dearing; William S. Feiler

[57] ABSTRACT

An apparatus for rock cutting and drilling. A preferred embodiment of the apparatus is a drill bit comprised of composite compact cutters removably secured or attached to the drill crown. The cutter is preferably comprised of a stud or pin with an abrasive composite compact bonded at one end of the stud. The securing means for the cutter is comprised of a sleeve and a bushing fixed in the recess of the bit crown. The sleeve has a threaded outer wall for engagement with a threaded inner wall of the bushing. The height of the cutter is adjustable by the provision of metal shims between the bottom of the recess and the base of the stud of the cutter.

10 Claims, 7 Drawing Figures

CUTTING AND DRILLING APPARATUS WITH THREADABLY ATTACHED COMPACTS

CROSS REFERENCE TO RELATED APPLICATIONS

U.S. Pat. No. 4,109,737 is directed to a rotary drill bit comprising a plurality of cutting elements, each of which is comprised of an elongated pin with a thin layer of diamond bonded to the exposed end of the pin. The pin is mounted by press fitting into the drill crown.

U.S. Pat. No. 4,098,362 is directed to a rotary drill bit comprising a plurality of diamond compact cutters. The diamond compact cutters are mounted in a drill crown by molding or by attachment to a cemented carbide pin which is in turn mounted in a drill crown by pressed fitting. Brazing is also disclosed as an alternate technique for mounting such compact cutters in the drill crown.

U.S. Pat. No. 4,156,329 is directed to a method for fabricating a drill bit comprising a plurality of composite compact cutters by furnace brazing each cutter in a recess in the crown of the drill bit. In one embodiment each cutter is comprised solely of a composite compact with a layer of brazing filler metal coating the exposed surface of the substrate of the compact. In another embodiment each cutter is comprised of a composite compact bonded to one end of a cemented carbide pin, the other and of which is fixed in a recess of the drill bit crown.

BACKGROUND OF THE INVENTION

This invention relates to apparatus for rock cutting and drilling and more particularly relates to mining, tunneling, or drilling machinery comprised of abrasive compact cutters.

A cluster compact is defined as a cluster of abrasive particles bonded together either (1) in a self-bonded relationship, (2) a means of a bonding medium disposed between the crystals, (3) by means of some combination of (1) and (2). Reference can be made to U.S. Pat. Nos. 3,136,615; 3,233,988; and 3,609,818 for a detailed disclosures of certain types of cluster compacts and methods for making same. (The disclosures of these patents are hereby incorporated by reference herein).

A composite compact is defined as a cluster compact bonded to a substrate material such as cemented tungsten carbide. The bond to the substrate can be formed either during or subsequent to the formation of the cluster compact. It is, however, highly preferred to form the bond during formation of the cluster compact. Reference can be made to U.S. Pat. Nos. 3,743,489, 3,745,623 and 3,767,371 for a detailed disclosure of certain types of composite compacts and methods for making same. (The disclosures of these patents are hereby incorporated by reference herein.)

Conventional rotary drill bits for oil and gas well drilling core drilling have heretofore used cutting elements such as (1)steel teeth, (2) steel teeth laminated with tungsten carbide, (3) a compact insert of cemented tungsten carbide, and (4) natural diamonds all of which are set or molded in a tungsten carbide crown or cone. Due to the relatively short life and/or high operating cost of these conventional designs, it has recently been proposed to use synthetic diamond compacts as the cutting element in such drills.

In one prior art design, a drill bit cutting element is formed by attaching a diamond composite compact with a cemented carbide substrate by brazing the carbide substrate to a cemented carbide pin. The pin is mounted in a hole in the drill crown. The diamond layer is generally oriented in a radial sense to the center of rotation of the drill bit and penetrates the rock essentially as a cutting tool in a similar manner to a cutting tool which is used to cut metal on a lathe.

In a second prior art design, a cutting element is formed by furnace brazing a diamond composite compact in a recess of the crown of the drill bit. A portion of the compact is extended beyond the outer surface of the crown and forms a cutting edge for the drill.

One problem which has been encountered in field tests of these designs is that the stresses on each cutting element is severe and some breakage or disattachment of the cutters has been encountered. The stresses are caused because the structure of most rocks is heterogeneous and thus have layers of varying hardness. These layers cause a large variation in the impact loads to be applied to the cutting elements during drilling, and thus, the bond strength of such designs is not always strong enough to withstand such a widely varying impact loading.

The failure of the compact cutters has given rise to a need for the individual repair of the cutters. Heretofore, this has not been practical because in all of the foregoing prior art designs the cutters are permanently mounted in the drill crowns by interference fitting, by molding of the cutters in the crown, or by furnace brazing of the cutters in the crown after formation of the drill crown.

Another problem encountered with such designs is that they do not permit the cutters to be adjusted in height relative to the crown and relative to other cutters after initial mounting of the cutters. This has lead to the premature failure of some cutters due to disproportionate engagement of the compact with the workpiece.

Still other problems are encountered with the prior art assembly techniques. As an example, one furnace brazing technique used with a cutter comprised of a composite compact bonded to a carbide pin is to mold the pin in place during formation of the crown and then simultaneously furnace braze a composite compact to each pin. Difficulty arises in providing adequate quality control for the attachment of the compact to the pin because to rebond one or more compacts, the whole bit must be resubjected to a furnace brazing cycle. This may be detrimental to the bond between the other compacts and pins as well as to the integrity of the abrasive layer which can only withstand limited exposure to the temperatures required to form the bonds.

Accordingly, it is an object of the invention to provide an improved apparatus for rock cutting and drilling.

It is another object of the invention to provide a drill bit comprised of compact cutters, the height of which are adjustable.

It is another object of the invention to provide a drill bit comprised of compact cutters which are removable for repair.

It is another object of the invention to provide a drill bit comprised of compact cutters which can be completely prefabricated prior to attachment to the drill bit crown.

SUMMARY OF THE INVENTION

These and other objects of the invention are accomplished by an apparatus comprising a support with at least one recess formed therein, at least one compact cutter and means for threadably securing the cutter in the recess. The cutter is preferably comprised of a stud or pin with an abrasive composite compact bonded at one end of the stud. The securing means for the cutter is comprised of a sleeve and a bushing fixed in the recess of the crown. The sleeve has a threaded outer wall for engagement with a threaded inner wall of the bushing. The height of the cutter is adjustable by the provision of metal shims between the bottom of the recess and the base of the stud of the cutter.

DESCRIPTION OF THE PREFERRED EMBODIMENTS

Figure 1A:
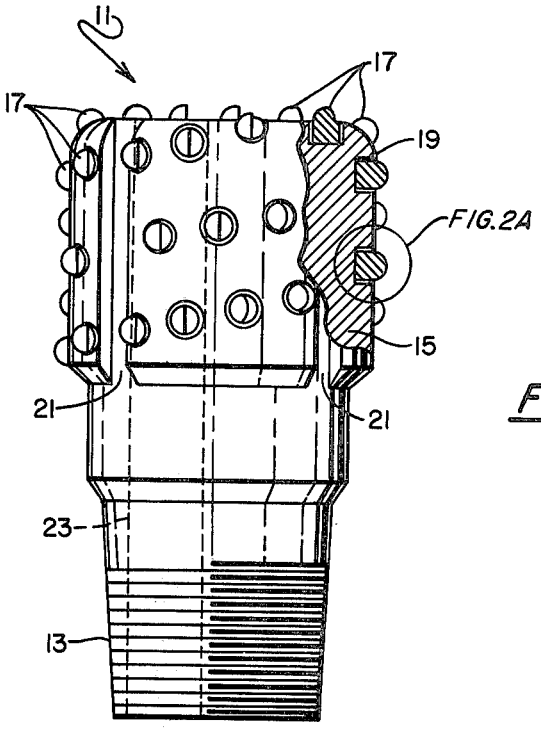
FIG. 1A is an elevational view of a drill bit in accordance with a preferred embodiment of the invention.
Figure 1B:
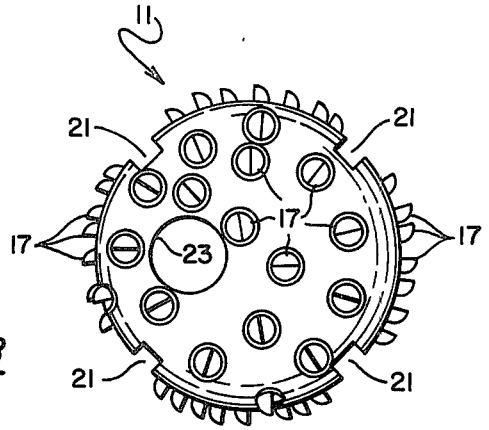
FIG. 1B is a plan view of the drill bit of FIG. 1A.

In FIGS. 1A, 1B a preferred embodiment of a drill bit 11 is shown in accordance with the features of this invention. Bit 11 is comprised of a shaft 13 and a drill crown 15 in which a plurality of cutting elements 17 are mounted in a plurality of recesses 19. Conventionally designed water ways 21 and a fluid port 23 are provided longitudinally of the bit 11. Crown 15 may be comprised, for example, of a conventional hard matrix material such as infiltrated tungsten carbide or steel.

Figure 2A:
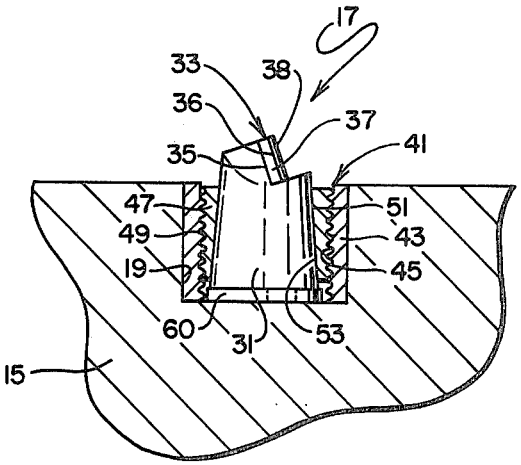
FIG. 2A is an enlarged fragmentary view of the drill bit of FIG. 1A.
Figure 2B:
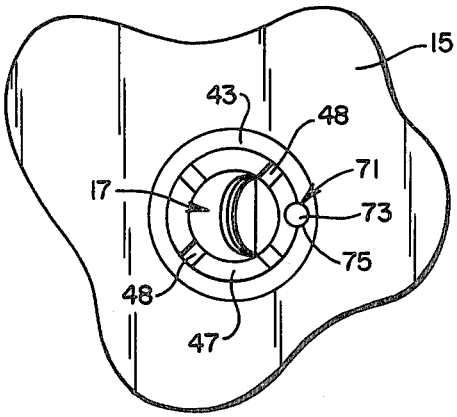
FIG. 2B is a plan view of the compact cutter shown in FIG. 2A.

FIGS. 2A, 2B illustrate in an enlarged view of one of the cutting elements 17 of bit 11 shown in FIGS. 1A, 1B. Cutting element 17 is comprised of an elongated cemented carbide stud 31 and a composite compact 33 bonded to the stud 31 along an interface 35. The bond formed at interface 35 between compact 33 and stud 31 may be formed by conventional brazing techniques. A preferred method for forming this bond is disclosed in the aforementioned U.S. patent application Ser. No. 796,635; the disclosure of which is hereby incorporated by reference herein. Briefly, this method comprises individually precoating the composite compact 33 and stud 31 with a silver base alloy by submersion in a molten bath of the alloy and then heating compact 33 and stud 31 in a furnace to form a bond therebetween. A preferred silver base alloy is BAG-1 (ASW-ASTM classification).

The cutting elements 17 are preferably disposed in crown 15 such that compact 33 engages a workpiece (e.g., rock surface) at a negative rake angle of between $-10°$ and $-25°$. This preferred disposition is described in detail in the aforementioned U.S. patent application Ser. No. 746,044, the disclosure of which is hereby incorporated by reference herein.

Composite compact 33 is preferably comprised of a mass of diamond 38 and a cemented carbide mass 37 bonded under high pressure/high temperature (HP/HT) along an interface 36 in accordance with the teaching of U.S. Pat. No. 3,745,623. Alternatively and less preferred, compact 33 is comprised of hard phase boron nitride (i.e., cubic boron nitride (CNB) and/or wurtzitic boron nitride (WBN) in accordance with the teaching of U.S. Pat. No. 3,743,489. (This patent discloses only CBN; however, WBN may be directly substituted in whole or in part for CBN.)

The bit (FIG. 2A) further comprises means 41 for threadably securing cutting element 17 in recess 19. Securing means 41 comprises a bushing 43 with a threaded inner wall 45, a sleeve 47 having a threaded outer wall 49 in threaded engagement with bushing wall 45. A plurality of notches 48 (FIG. 2B) are provided in sleeve 47 for inter-connection with a toothed wrench for installation and removal of sleeve 47. The outer wall 51 of stud 31 and the inner wall 53 of sleeve 47 are tapered such that a portion of wall 51 has a diameter $\geqq d_1$ for engagement with a portion of wall 53 which has a diameter $< d_1$. This relationship between the diameters of outer wall 51 and inner wall 53 enables the sleeve upon being firmly screwed into bushing 43 to firmly secure stud 31 in recess 19. When crown 15 is constructed of a hard matrix material, bushing 43 may be constructed, for example, of steel and may be fixed in a recess 19 by molding of the bushing 43 in crown 15 during formation of crown 15. When crown 15 is made of steel, bushing 43 may be formed as an integral part of the crown. The threads may be cut in a recess 19 to receive a threaded sleeve 43.

In accordance with another feature of this invention the height of a cutting element 17 relative to crown 15 and relative to other cutters 17 may be adjusted by the provision of height adjustment means comprised of metal shim(s) 60 positioned between stud 31 and the bottom of recess 19. This enables the degree of engagement of the cutters with the workpiece to be properly adjusted thereby preventing premature failure of a cutter due to excessive and disproportionate engagement with a workpiece. This was not possible in prior art designs.

As shown in FIG. 2B, the securing means 41 may additionally comprise a sleeve locking means 71 to secure the sleeve against rotation relative to bushing 43. The sleeve lock 71 may comprise a metal pin 73 fitted into a hole 75 drilled longitudinally of the threaded interface between bushing 43 and sleeve 47. The sleeve lock 71 may be constructed by drilling hole 75 after sleeve 47 has threadably secured cutting element 17 in recess 19 and thereafter driving metal pin 73, for example of steel, into hole 75.

Figure 2C:
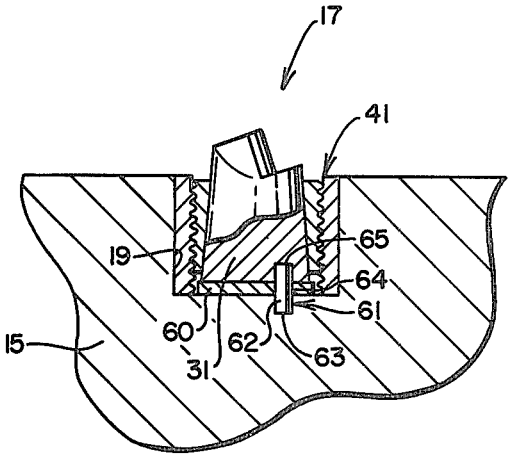
FIG. 2C is a fragmentary view of a portion of the compact cutter shown in FIG. 2A.

In FIG. 2C, a locating means 61 is provided in the base of recess 19 for preventing rotation of cutting element 17 about the longitudinal axis of element 17. The locating means 61 may comprise, for example, a metal pin 62 passing through an aperature 64 in shim 60 and having the ends thereof fitted into a recess 63 formed in crown 15 and into a recess in the lower surface of stud 31, respectively. The rotational securement of the stud 31 enables the cutting elements 17 to be easily oriented on the crown 15 so as to engage a rock surface at the proper angle.

Figure 3:
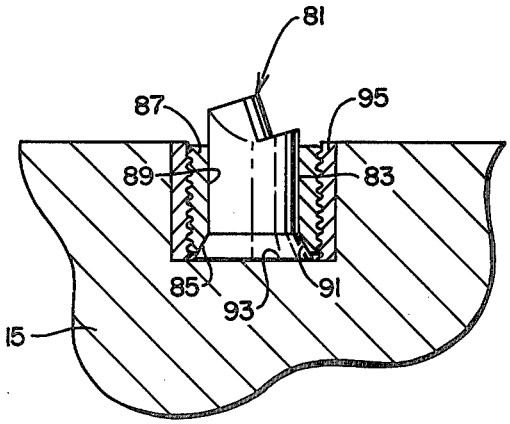
FIG. 3 is a fragmentary cross sectional view of an alternate embodiment of a drill bit comprising composite compact cutters in accordance with an alternate embodiment of the invention.

FIG. 3 shows an alternative embodiment of the invention. This embodiment may be identical to that shown in FIGS. 2A, 2C except that (1) a cutting element 31 has an outer wall 83 with a portion of diameter $\geqq d_1$ provided by a tapered flange 85 and (2) sleeve 87 has an inner wall 89 with a portion of a diameter $< d_1$ provided by a flaring opening 91 at one end of sleeve 87. The cutting element 81 is threadably secured in a recess 93 by positioning the element 81 in recess 93 and then firmly screwing sleeve 87 into bushing 95.

Figure 4:
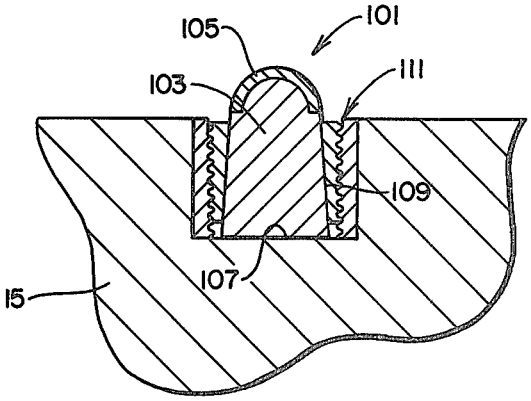
FIG. 4 is a fragmentary view of a drill bit comprised of compact cutters in accordance with still another embodiment of this invention.

FIG. 4 illustrates an alternate embodiment of cutting element 101 which may be used in place of those shown in FIGS. 2 or 3. Cutting element 101 is comprised of a sintered carbide pin 103 and a thin layer of polycrystalline abrasive 105 bonded to one end of pin 103. Pin 103 is formed with a tapered outer wall 109 having a portion thereof with a diameter $\geqq d_1$ as described in the embodiment shown in FIG. 2A. Alternatively, and not shown, the outer wall of pin 103 may be formed with a tapered flange as shown in FIG. 3. A securing means threadably securing element 101 in a recess 107 may be provided identical to that shown in the embodiments of either FIG. 2 or 3. A securing means 111 is here shown identical to means 41 of FIG. 2A.

Cutting element 101 is preferably constructed in accordance with the high pressure/high temperature process disclosed in U.S. patent application Ser. No. 699,411, the disclosure of which is hereby incorporated by reference herein. In accordance with application Ser. No. 699,411, the high pressure bond formed along the interface between the abrasive mass 105 and pin 103 is free of voids, irregular and interlocked on a scale of about 1–100 micrometers. Temperatures between 1350° C. and 2000° C. and pressures of at least 40 kilobars in the diamond stable region are preferred. As will be recognized, variations of the cutting element shown in FIGS. 4B–4G of Ser. No. 699,411 may also be used to form alternative embodiments of this invention.

Elements 101 are preferably disposed in a bit with the elements longitudinal axis substantially perpendicular to a line tangent to the point of intersection of the axis with the surface of the bit crown. Further details of this disposition are also disclosed in Ser. No. 699,411.

While the invention has been described in connection with certain preferred and illustrative embodiments thereof, it will be apparent to those skilled in the art that the invention is not limited thereto. Thus, it is intended that the appended claims cover all modifications which are within the true spirit and scope of the invention.

I claim:

1. In a drill bit comprising:

(a) a support;

(b) at least one recess formed in said support;

(c) at least one cutting element including a stud and a mass of bonded abrasive particles bonded to said stud, a cutting element mounted in each recess;

the improvement which comprises a securing means for each cutting element defined by:

(d) threaded means associated with said recess and defining a threaded inner wall;

(e) said stud having a frustoconical shape over at least part of its length and having its largest diameter toward the support; and (f) a sleeve having an inner wall and a threaded outer wall; such that the outer wall of the sleeve may be threadably engaged with the inner wall of the threaded means and the inner wall of the sleeve is disposed around and engages said stud, whereby said stud is secured in said recess.

2. The improvement in a drill bit as recited in claim 1 wherein said threaded means comprises a bushing fixed in said recess.

3. The drill bit improvement of claim 1 further comprising locking means for preventing said sleeve from turning in said recess, said locking means comprising a pin inserted in a hole along the interface between said sleeve and said bushing.

4. The drill bit improvement of claim 1, wherein said threaded means comprises threads cut in the inner wall of said recess.

5. The drill bit improvement of claim 1 wherein said stud is cemented carbide.

6. The drill bit improvement of claim 1 wherein the bond between said particle mass and said stud is formed by an intermediate mass of cemented carbide, said carbide mass bonded along one interface to said particle mass and bonded along a second interface to said stud.

7. The drill bit improvement of claim 6 wherein said particle mass and said carbide mass together comprise a high pressure/high temperature composite compact.

8. A drill bit comprising:

(a) a support;

(b) at least one recess formed in said support;

(c) a cutting element including a stud and a mass of bonded abrasive particles bonded to said stud;

(d) means for threadably securing said stud in said recess, said securing means including a bushing fixed in said recess and having a threaded inner wall; a sleeve, said sleeve being disposed about said stud and having a threaded outer wall in threaded engagement with said bushing inner wall; and (e) locking means for preventing said sleeve from turning in said recess, said locking means comprising a pin inserted in a hole along the interface between said sleeve and said bushing.

9. The drill bit improvement of claim 8 further comprising a means for adjusting the height of said stud relative to said support which comprises at least one shim positioned between the stud and the bottom of the recess.

10. The drill bit improvement of claim 9 which further comprises a locating means for preventing rotation of the cutting element, which comprises a metal pin passing through an aperture in the shims and having the ends thereof fitted into recesses formed in the support and in the stud.

* * * * *